US008978785B2

(12) United States Patent
Shotton

(10) Patent No.: US 8,978,785 B2
(45) Date of Patent: Mar. 17, 2015

(54) AIR FILTRATION FOR ROCK DRILLING

(75) Inventor: Vincent Wayne Shotton, Magnolia, TX (US)

(73) Assignee: Sandvik Mining and Construction, Shenandoah, TX (US)

( * ) Notice: Subject to any disclaimer, the term of this patent is extended or adjusted under 35 U.S.C. 154(b) by 373 days.

(21) Appl. No.: 12/351,163

(22) Filed: Jan. 9, 2009

(65) Prior Publication Data

US 2009/0173545 A1 Jul. 9, 2009

Related U.S. Application Data

(60) Provisional application No. 61/019,860, filed on Jan. 9, 2008.

(51) Int. Cl.

| | |
|---|---|
| ***E21B 7/00*** | (2006.01) |
| ***E21B 41/00*** | (2006.01) |
| ***E21B 21/01*** | (2006.01) |

(52) U.S. Cl.

CPC ..... *E21B 21/01* (2013.01)
USPC ..... 175/310; 175/323; 175/69; 175/215; 166/105.5; 166/222; 95/269; 95/270; 95/271

(58) Field of Classification Search

CPC ..... E21B 21/01
USPC ..... 166/265, 105.5, 222; 175/323, 310, 69, 175/68, 71, 215, 207, 212; 95/269, 270, 95/271

See application file for complete search history.

(56) References Cited

U.S. PATENT DOCUMENTS

| | | | | | |
|---|---|---|---|---|---|
| 2,413,324 | A | * | 12/1946 | Holzwarth | 55/452 |
| 2,879,846 | A | * | 3/1959 | Dawson, Jr. | 166/286 |
| 3,802,162 | A | | 4/1974 | Deane | |
| 3,813,854 | A | | 6/1974 | Hortman | |
| 3,887,342 | A | | 6/1975 | Bunnelle | |
| 4,179,273 | A | | 12/1979 | Montusi | |
| 4,245,710 | A | | 1/1981 | Dolezal et al. | |
| 4,388,087 | A | | 6/1983 | Tipton | |
| 4,515,229 | A | * | 5/1985 | Drummond et al. | 175/337 |
| 4,646,858 | A | | 3/1987 | Strickland | |
| 4,971,603 | A | * | 11/1990 | Prinsloo et al. | 95/269 |

(Continued)

FOREIGN PATENT DOCUMENTS

| | | | | |
|---|---|---|---|---|
| CA | 2388070 | A1 | 11/2002 | |
| EP | 1600215 | A1 * | 11/2005 | B04C 3/06 |

(Continued)

OTHER PUBLICATIONS

Official action dated Apr. 12, 2010, in corresponding Canadian patent application # 2,648,805. 4 Pages.

(Continued)

*Primary Examiner* — James G Sayre
(74) *Attorney, Agent, or Firm* — Osha Liang LLP

(57) ABSTRACT

A downhole tool to separate liquid from a drilling fluid includes a multi-vein cyclonic separator disposed within a housing, the cyclonic separator including at least two veins extending in a spiral along the length of the cyclonic separator, holes in the housing positioned adjacent to edges of veins of the cyclonic separator to allow liquid accelerated from the drilling fluid to exit the housing, and wherein the cyclonic separator is configured to provide high centrifugal forces to the drilling fluid downhole.

15 Claims, 6 Drawing Sheets

(56) References Cited

U.S. PATENT DOCUMENTS

| | | | | |
|---|---|---|---|---|
| 5,355,967 | A | 10/1994 | Mueller et al. | |
| 5,431,228 | A * | 7/1995 | Weingarten et al. | 166/357 |
| 5,490,571 | A * | 2/1996 | Hanns et al. | 175/323 |
| 5,740,919 | A * | 4/1998 | Stowe | 209/223.1 |
| 6,036,749 | A * | 3/2000 | Ribeiro et al. | 95/261 |
| 6,080,312 | A | 6/2000 | Bowers et al. | |
| 6,189,613 | B1 | 2/2001 | Chachula et al. | |
| 6,554,066 | B2 * | 4/2003 | Lopes et al. | 166/265 |
| 2001/0004017 | A1 * | 6/2001 | Lopes | 166/265 |
| 2003/0136587 | A1 * | 7/2003 | Boulet | 175/323 |
| 2003/0145724 | A1 * | 8/2003 | Betting et al. | 95/29 |
| 2005/0281683 | A1 | 12/2005 | Brown et al. | |
| 2007/0083061 | A1 | 4/2007 | Hanselmann et al. | |
| 2009/0139938 | A1 * | 6/2009 | Larnholm et al. | 210/788 |

FOREIGN PATENT DOCUMENTS

| | | | | |
|---|---|---|---|---|
| WO | 200685759 | A1 | 8/2006 | |
| WO | WO 2006/085759 | A1 * | 8/2006 | B04C 3/00 |

OTHER PUBLICATIONS

Examiner's First Report issued in corresponding Australian Patent Application No. 2009200074; Dated Nov. 2, 2010 (4 pages).

Office Action issued in corresponding Chilean Patent Application No. 38-2009; Dated Mar. 1, 2011 (8 pages).

English Language Communication regarding the Office Action issued in corresponding Chilean Patent Application No. 38-2009; Mailed Mar. 31, 2011 (2 pages).

* cited by examiner

AIR FILTRATION FOR ROCK DRILLING

CROSS-REFERENCE TO RELATED APPLICATIONS

This application, pursuant to 35 U.S.C. §119, claims priority to U.S. Provisional Application Ser. No. 61/019,860 filed Jan. 9, 2008. That application is incorporated by reference in its entirety.

BACKGROUND OF INVENTION

1. Field of the Disclosure

Embodiments disclosed herein relate generally to rock drilling operations. More particularly, embodiments disclosed herein relate to air filtration devices used in water injected dust suppression devices for rock drilling operations.

2. Background Art

Drilling into rock formations to enable explosive charges to be placed for excavating ore in open-cut mining operations may be carried out by rotary air blast drills. Air at high pressure (typically 40 psi) and volume (750 to 2000 cubic feet a minute (cfm)) may be delivered through a bore in the drill string to the drill bit. The air supplied to the drill bit, which may for example be a blade or roller type bit, exits from orifices or nozzles in the bit, cools the bearings of the bit and conveys the debris created by the drilling away from the drilling workface up the borehole. This debris may travel up the borehole at a typical (bailing) velocity of 5,000 to 7,000 feet per minute depending on the size of the borehole and the drill string.

The debris produced may include particulate matter and dust. To reduce the dispersion of dust into the environment, which may have deleterious effects on equipment and personnel, the debris is sprayed with water. The water may be supplied with the air through the drillstring to the drill bit and in addition to suppressing dust, may also cause accelerated bearing failure. This is because the air being sent via the drillstring, in an open air bearing rotary tool, is used to cool the bearings as well as flush out cuttings within the bearing because there is no sealing system. As a result of now introducing water with the air via the drillstring, the bearing life may be reduced. Some of the potential failure modes by having water in the bearing may include an increased potential for spalling, hydrogen embrittlement, or accelerated wear of the components. Accordingly, there exists a need for a device capable of reducing or preventing water into air-driven rotary tools.

SUMMARY OF THE DISCLOSURE

In one aspect, embodiments disclosed herein relate to a downhole tool to separate liquid from a drilling fluid, the downhole tool including a multi-vein cyclonic separator disposed within a housing, the cyclonic separator including at least two veins extending in a spiral along the length of the cyclonic separator, holes in the housing positioned adjacent to edges of veins of the cyclonic separator to allow liquid accelerated from the drilling fluid to exit the housing, and wherein the cyclonic separator is configured to provide high centrifugal forces to the drilling fluid downhole.

In another aspect, embodiments disclosed herein relate to a downhole tool to separate liquid from a drilling fluid, the downhole tool including a cyclonic separator disposed within a housing, the cyclonic separator including a first vein extending in a spiral along the length of the cyclonic separator, wherein the first vein comprises a variable pitch along the length of the cyclonic separator. The cyclonic separator also includes holes in the housing positioned adjacent to edges of the first vein to allow liquid accelerated from the drilling fluid to exit the housing, wherein the cyclonic separator is configured to provide high centrifugal forces downhole to the drilling fluid.

In another aspect, embodiments disclosed herein relate to a downhole tool to separate liquid from a drilling fluid, the downhole tool including an impeller-type separator disposed within a housing, the impeller-type separator including a plurality of blades in a circular arrangement about a central axis. The impeller-type separator also includes holes in the housing to allow liquid accelerated by the plurality of blades from the drilling fluid to exit the housing, wherein the impeller-type separator is configured to provide increased centrifugal forces to the drilling fluid downhole.

Other aspects and advantages of the invention will be apparent from the following description and the appended claims.

DETAILED DESCRIPTION

In one aspect, embodiments disclosed herein relate generally to rock drilling operations. More particularly, embodiments disclosed herein relate to air filtration devices used in water injected dust suppression devices for rock drilling operations.

Figure 1:
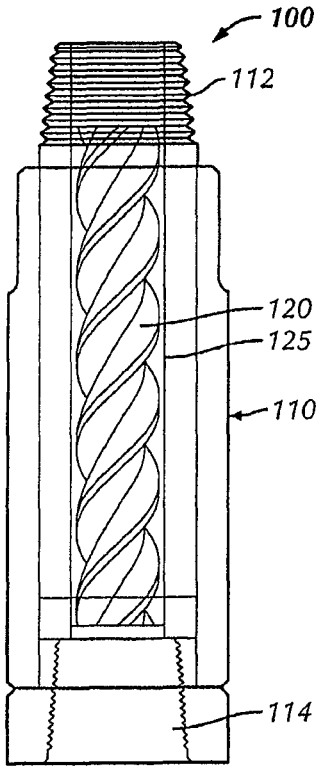
FIG. 1 shows an assembly view of an air filtration device in accordance with embodiments of the present disclosure.

Referring to FIG. 1, a section view of an air filtration device 100 in accordance with embodiments of the present disclosure is shown. Air filtration device 100 includes a separator subassembly 110 which has a drillpipe connection 112 at a top end and a rotary tool connection 114 at a bottom end. Those skilled in the art will understand methods to connect a drillpipe (not shown) and rotary tool (not shown) to separator subassembly 110 including, but not limited to, threading. Air filtration device 100 may be disposed within or adjacent (above or below in the drillstring) to a drillstring component, including but not limited to, a rotary tool, stabilizer, or other drillstring component known to those skilled in the art.

Figure 2:
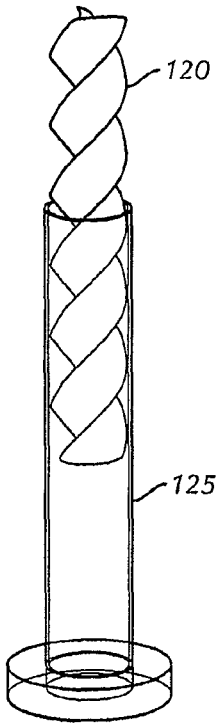
FIG. 2 shows an assembly view of a cyclonic type separator subassembly in accordance with embodiments of the present disclosure.

Further, in certain embodiments, separation subassembly 110 may include a multi-vein cyclonic separator 120 disposed in a housing 125 configured to rotate with the drillstring. Referring to FIG. 2, an assembly view of multi-vein cyclonic separator 120 and housing 125 is shown in accordance with embodiments of the present disclosure. Multi-vein separator 120 is shown partially disassembled from housing 125.

Figure 3:
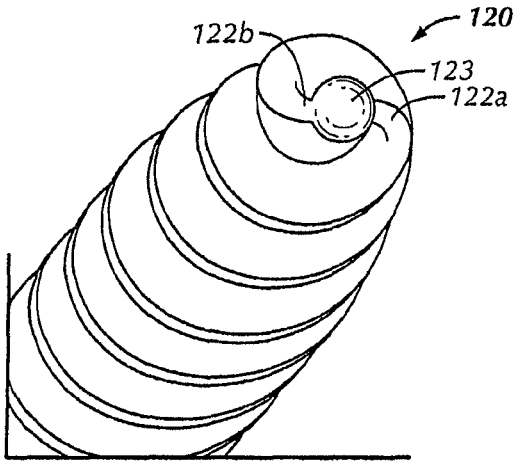
FIG. 3 shows an end view of a multi-vein separator in accordance with embodiments of the present disclosure.

In FIG. 3, an exploded view of one end of a multi-vein cyclonic separator 120 is shown in accordance with selected embodiments of the present disclosure. Multi-vein separator 120 includes at least two individual veins 122A and 122B which extend in a spiral along the entire length of a center core 123 of separator 120. A person skilled in the art will understand that any number of individual veins 122 may be used on separator 120. Further, veins 122 may have a uniform pitch or a variable pitch (increasing or decreasing) along the length of the cyclonic separator.

Figure 4:
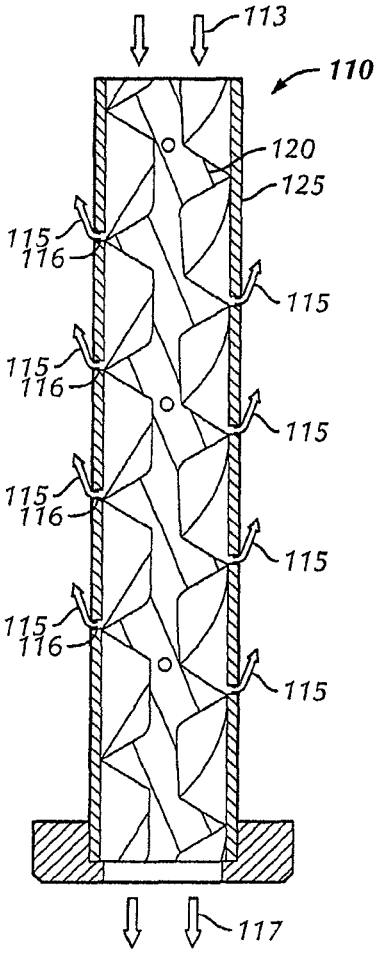
FIG. 4 shows a section view of a cyclonic separator subassembly in accordance with embodiments of the present disclosure.

Referring to FIG. 4, a section view of cyclonic separator subassembly 110 is shown in accordance with embodiments of the present disclosure. In embodiments disclosed herein, a mixture of air and water 113 enters housing 125 of separator subassembly 110 and is forced to "swirl" in a vortical manner through separator 120. High centrifugal forces applied to the mixture 113, as well as a density difference between the air and water, may cause the more dense material (i.e., water) to centrifugally separate from the air. After separation of mixture 113, the fluid (water) 115 may be removed from separator subassembly 110 as it travels toward outer edges of the separator veins and through holes 116 in the outer tubular wall of housing 125. The fluid 115 may then exit upstream above the rotary tool (not shown) and into the hole which has been drilled. After the air and water mixture 113 has traveled through separator subassembly 110, and water 116 has been removed, the remaining air 117 may exit separator subassembly 110 and continue into an attached rotary tool.

Referring to FIGS. 5A-5F, component views of various configurations of multi-vein cyclonic separators are shown in accordance with selected embodiments of the present disclosure. As used herein, "vein pitch" may be defined as the amount of axial spacing between adjacent edges of a vein as it extends in a spiral along the length of the separator. A "constant" vein pitch is defined as equal spacing along the length of the separator; a "variable" vein pitch is defined as uneven spacing (increasing or decreasing space between vein edges) along the length of the separator. Further, a "taper" may exist in both the veins and core of the separator, and is defined as a decreasing diameter in the veins, core, or both along the length of the separator from one end to the other.

Figure 5A:
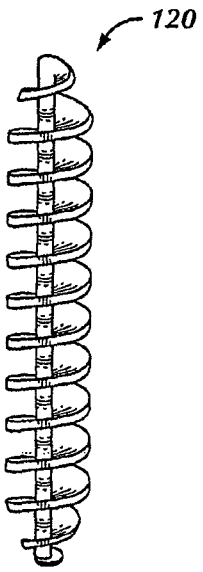
FIG. 5A (Prior Art)
FIG. 5A shows a prior art cyclonic separator.

FIG. 5A shows a prior art single vein cyclonic separator having constant vein pitch.

Figure 5B:
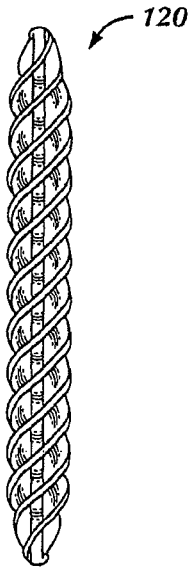
FIG. 5B-5F show component views of various configurations of cyclonic separators in accordance with embodiments of the present disclosure.

FIG. 5B shows a multi-vein cyclonic separator having a constant vein pitch in accordance with embodiments of the present disclosure.

Figure 5C:
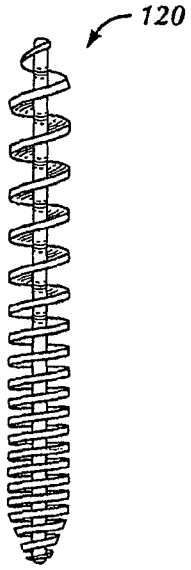

FIG. 5C shows a single vein cyclonic separator having a variable vein pitch in accordance with embodiments of the present disclosure.

Figure 5D:
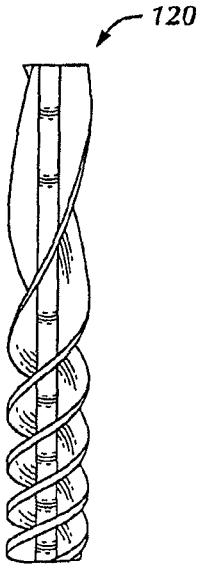

FIG. 5D shows a multi-vein cyclonic separator having a variable vein pitch in accordance with embodiments of the present disclosure.

Figure 5E:
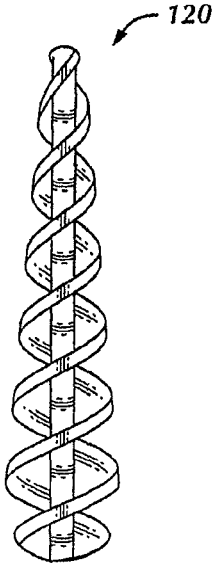

FIG. 5E shows a multi-vein cyclonic separator having a tapered vein and a constant core in accordance with embodiments of the present disclosure.

Figure 5F:
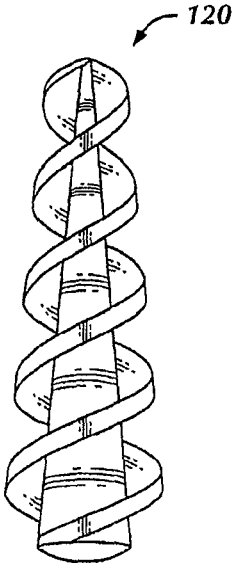

FIG. 5F shows a multi-vein cyclonic separator having a tapered vein and tapered core in accordance with embodiments of the present disclosure.

Figure 6A:
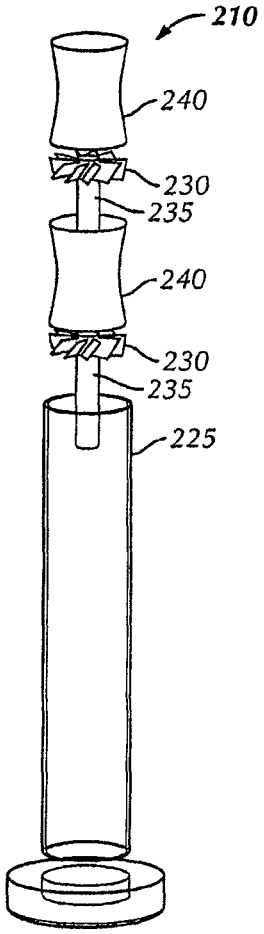
FIG. 6A shows an assembly view of an impeller type separator subassembly in accordance with embodiments of the present disclosure.
Figure 6B:
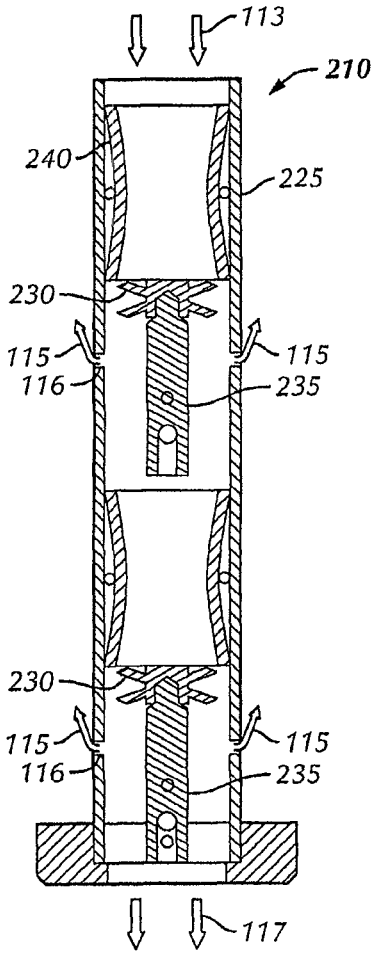
FIG. 6B shows a section view of an impeller type separator subassembly in accordance with embodiments of the present disclosure.

Referring to FIG. 6A, an assembly view of an impeller separator subassembly 210 is shown in accordance with embodiments of the present disclosure. Separator subassembly 210 is shown disassembled, and includes impeller separators 230 and venturi nozzles 240 disposed within a housing 225. Now referring to FIG. 6B, a section view of separator subassembly 210 is shown in further detail. Separator subassembly 210 includes impellers 230 mounted on a shaft 235, and further includes venturi nozzles 240. Those skilled in the art will understand various configurations possible such as the number of impellers 230 used, the number of venturi nozzles 240 used, and arrangements between impellers 230 and venturi nozzles 240. In certain embodiments, the separator subassembly may only include one or more venturi nozzles in sequence. In further embodiments, a venturi nozzle may not be required and the separator subassembly may only include one or more impellers in sequence.

As described before, a mixture of air and water 113 enters housing 225 of separator subassembly 210 and is forced to "swirl" in a vortical manner. High centrifugal forces are applied to the mixture, and along with the density difference between the air and water, causes the more dense material, water, to centrifugally separate from the air. After separation of mixture 113, the fluid (water) 115 may be removed from the air through holes 116 in the outer tubular wall of housing 225. The fluid 115 may exit upstream above the rotary tool (not shown) and into the hole which has been drilled. After air/water mixture 113 has traveled through separator subassembly 210 and water 115 has been removed, air 117 may exit separator subassembly 210 and continue on into an attached rotary tool.

The impeller concept may allow for a localized change in flow direction via rotational movement causing the different phases, or densities, to separate due to high centrifugal forces. Impellers 230 may be stationary with respect to the system or drillstring (not shown) and therefore rotate with the drillstring, or they may rotate within the drillstring. Further, a series of impellers 230 may be arranged next to each other along the system to promote more separation. A combination of the impellers and the venturi nozzles in sequence may induce higher flow velocities and create an atomization process or separation of the fluid particles within the air and fluid mixture.

Now referring to FIGS. 7A-7D, component views of various embodiments of impellers 210 are shown in accordance with embodiments of the present disclosure. As used herein, "blade" pitch may be defined as the angle of the blades as positioned on the impeller. A higher blade pitch may be closer to vertical, or closer to parallel in relation to an axis through the center of the impeller, than a lower blade pitch.

Figure 7A:
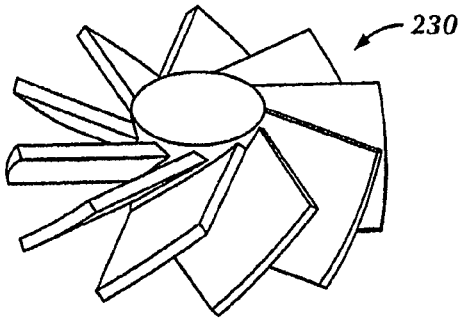
FIG. 7A-7D show component views of various configurations of impellers in accordance with embodiments of the present disclosure.

FIG. 7A shows an impeller having flat blades and a higher blade pitch in accordance with embodiments of the present disclosure.

Figure 7B:
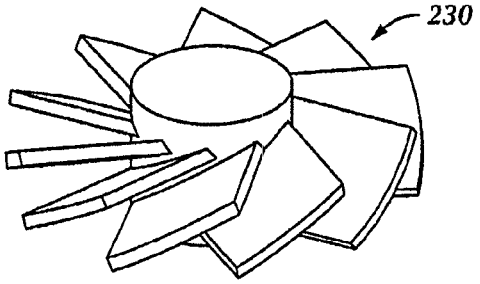

FIG. 7B shows an impeller having flat blades and a lower blade pitch in accordance with embodiments of the present disclosure.

Figure 7C:
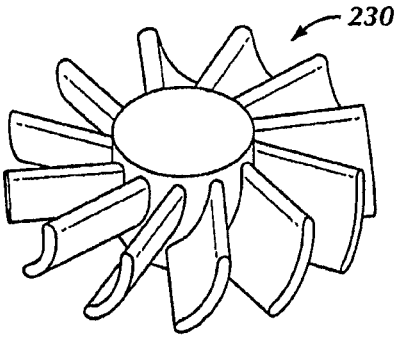

FIG. 7C shows an impeller having uniform curved blades in accordance with embodiments of the present disclosure.

Figure 7D:
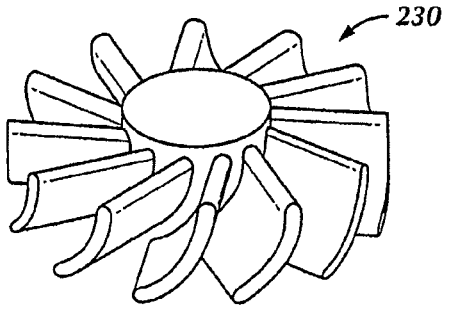

FIG. 7D shows an impeller having variable curved blades in accordance with embodiments of the present disclosure.

Figure 8:
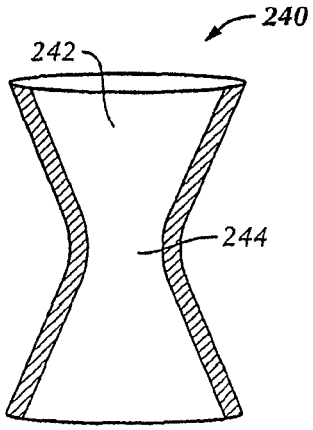
FIG. 8 shows a section view of a venturi nozzle in accordance with embodiments of the present disclosure.

Referring to FIG. 8, a section view of a venturi nozzle 240 is shown in accordance with embodiments of the present disclosure. Fluid flow through venturi nozzles is well understood in the art. The pressure differential between location 242 and location 244 may be used to create moisture droplets through an atomization process. The use of venturi nozzles may produce higher velocity streams, which may induce or provide better or more efficient mixture separation.

Experimental procedures conducted to compare performance between various separator configurations showed improved performance by embodiments disclosed herein. Two significant performance parameters compared were "vorticity" values in the separators and pressure drops across the separators. As used herein, a vorticity value may be defined as a vector measure of local circulation in a fluid flow and may be used to predict separation of multiphase flow. Higher vorticity values may correspond to higher centrifugal forces which are applied to the fluid during operation, and would therefore correspond to a higher separation efficiency of the separator.

Figure 9:
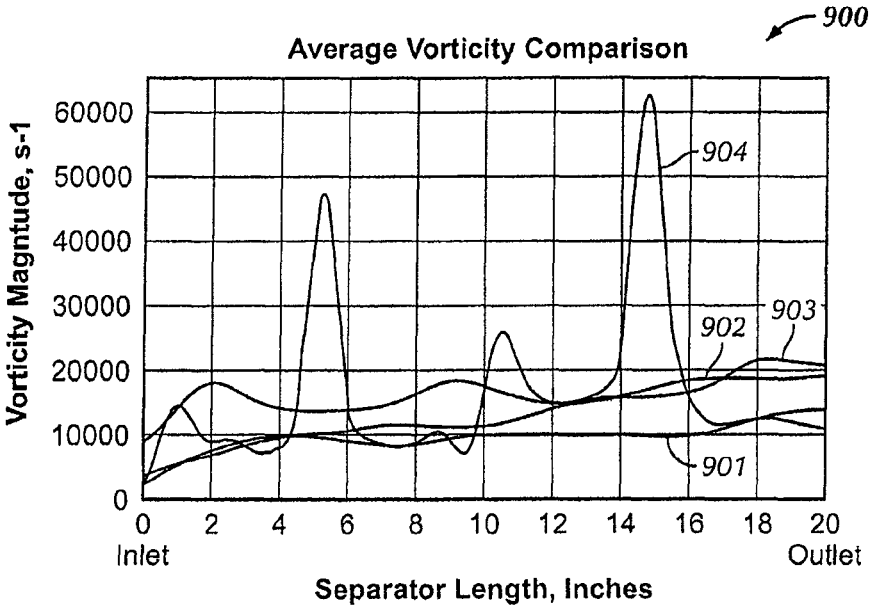
FIG. 9 shows a chart comparing vorticity values among various separators in accordance with embodiments of the present disclosure.

Referring to FIG. 9, a chart showing average vorticity comparisons 900 of various separator subassemblies tested is shown in accordance with embodiments of the present disclosure. The separator subassemblies were modeled against a base model separator 901 having a single cyclonic vein with a constant pitch, and functioning similarly to the separator described and shown in FIG. 5A. The base model separator 901 having the single constant pitch vein was shown to have average vorticity values with little slope from inlet to outlet. Separator 901 provided base separation efficiency values by which to compare various embodiments disclosed herein.

A separator having multiple veins with a constant pitch 902 (FIG. 5B) was shown to have higher overall vorticity values along the length when compared to single vein separator 901, and therefore predicted increased separation efficiency.

A separator having a single vein with a variable pitch 903 (FIG. 5C) was modeled and was shown to have vorticity values that constantly increased from inlet to outlet. Separator 903 showed vorticity values close to separator 901 initially, however the vorticity values of separator 903 increased and were higher as the vein pitch increased along the separator. Therefore, predicted separation efficiency of separator 903 increased along the length.

Finally, a separator having a dual venturi and impeller combination 904 and functioning as described and shown in FIG. 6 was compared to single vein cyclonic separator 901. This design (904) showed vorticity values which were more localized and also much higher (orders of magnitude higher) than single vein cyclonic separator 901. The "spikes" or peaks shown in FIG. 9 for separator 904 represent the locations of the impellers; therefore the impellers provided greatly increased predicted separation efficiency as compared to the base model separator 901.

Further, the pressure drops and fluid velocity comparisons across the various separators were modeled and compared, the results of which are shown in Table 1 below. As shown, the multi-vein cyclonic separator 902 was shown to have the smallest pressure drop along its length when compared to the base model single vein separator 901.

TABLE 1

Pressure Drop and Velocity Comparison

| Design | System Pressure Drop (psi) | Maximum Air Mach Number |
|---|---|---|
| 901 | 75.7 | 0.836 |
| 902 | 45.3 | 0.741 |
| 903 | 71.6 | 0.758 |
| 904 | 67.6 | 0.822 |

The modeled data described above may be used to optimize separator designs, however, there are often trade-offs between the performance characteristics or parameters involved in optimizing the separators. For example, in theory, there may be a trade-off between the two performance parameters modeled, i.e., pressure drop and water separation efficiency; the higher the pressure drop across the separator, the greater the separation efficiency and vice versa. Therefore, one performance characteristic may be sacrificed at the expense of increasing the other.

In contrast, embodiments of the present disclosure may provide separators capable of increasing both performance characteristics (i.e., pressure drop and separation efficiency). Looking at the data obtained from the models of multi-vein separator 902, a smaller pressure drop across the separator, and higher vorticity values (indicating higher separation efficiencies) are shown. Further, comparing pressure drop and vorticity values obtained for impeller type separator 904, the pressure drop across the separator was similar to single vein separator 901, however, the vorticity values shown in FIG. 9 are orders of magnitude (up to six times) higher than vorticity values of single vein separator 901.

In current designs (901), the amount of volume required in the air filtration device to create high vorticity values desired may potentially be much greater when compared to an impeller type separator system (904). From the fluid dynamic modeling shown in FIG. 9, the vorticity values of an impeller type design (904) are on the order of six times more versus current designs (single vein cyclonic 901). The high vorticity values were shown to be possible without having a significant pressure drop across the impeller separators, and while maintaining near equivalent Mach numbers (fluid velocities) as compared to the current design 901. The impeller type separator system 904 may therefore require less space to perform the same function but with greatly increased separation efficiency.

Advantageously, the multi-vein cyclonic separators were shown to predict an increase in separation efficiency (higher vorticity values) with a lower pressure drop through the separator. The multi-vein separators may be less sensitive to nozzle adjustments (i.e., sizing) which may lead to increased water separation efficiency. The impeller type separators were shown to have increased vorticity values, resulting in a separator requiring less space as previously mentioned. In embodiments with venturi nozzles, the impeller type separators were shown to provide an increased velocity, predicting more efficient water separation and removal.

Figure 10:
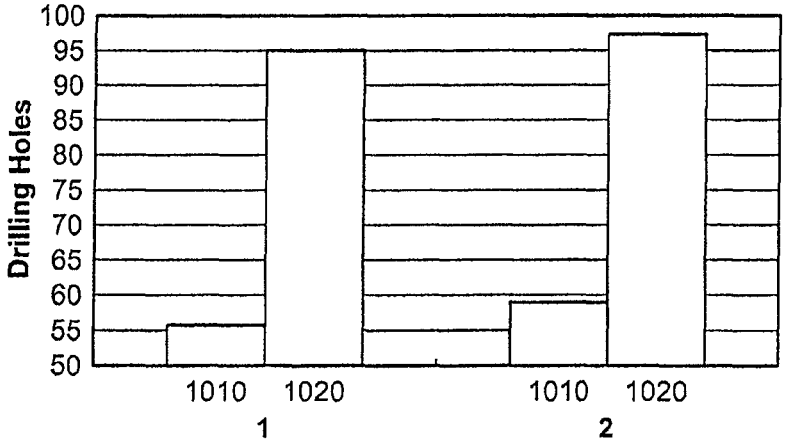
FIG. 10 shows a chart comparing systems with and without air filtration devices to drilling hours in accordance with embodiments of the present disclosure.

Advantageously, embodiments of the present disclosure for the air filtration device may promote increased bearing life in the rotary tool by removing the water before it is able to enter the rotary tool. Referring to FIG. 10, a bar chart 1000 is shown comparing the life of a system without the air filtration device 1010 to a system with the air filtration device 1020 in two different models (1 and 2). As shown in both models 1 and 2, the system with the air filtration device 1020 showed greatly increased life expectancy over the system without the air filtration device 1010, and therefore was capable of more drilling hours.

In general, the air filtration device may significantly increase the rotary tool or drill bit life by removing the water before it enters. This increased bit life may increase productivity by not having to replace the bit as often, as well as reduce drilling costs due to downtime. Further, overall costs may be reduced by having to buy fewer bits. Further, operating costs will be reduced on a cost per meter/foot drilled by having the bit last longer for the same cost of the drill bit.

Further, embodiments of the present disclosure may be less sensitive to nozzle sizing requirements. Previously, a reduction in the nozzle size used was required because of higher pressure drops experienced across the separator. In embodiments disclosed herein, the nozzles may not have to be tailored to correspond to the separator being used, allowing for fewer requirements and more flexibility in design.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed is:

1. An air filtration device disposed proximate a rotary mining bit in a drillstring to separate liquid from a drilling fluid, the air filtration device comprising:

a multi-vein cyclonic separator disposed within a housing configured to rotate with the drillstring, the cyclonic separator comprising:

at least two veins extending in a spiral along the length of the cyclonic separator;

wherein the multi-vein cyclonic separator comprises a tapered core having a decreasing diameter along an entire axial length of the multi-vein cyclonic separator;

holes in the housing positioned adjacent to edges of veins of the cyclonic separator to allow liquid accelerated from the drilling fluid to exit the housing;

wherein the cyclonic separator is configured to provide high centrifugal forces to the drilling fluid downhole.

2. The air filtration device of claim 1, wherein the multi-vein cyclonic separator is disposed within a drillstring component.

3. The air filtration device of claim 1, wherein the multi-vein cyclonic separator is disposed in a drillstring immediately adjacent to a drillstring component.

4. The air filtration device of claim 1, wherein the multi-vein cyclonic separator is configured to produce increased vorticity values in the drilling fluid.

5. The air filtration device of claim 1, wherein the liquid accelerated from the drilling fluid comprises water.

6. The air filtration device of claim 1, wherein the drilling fluid comprises air.

7. The air filtration device of claim 1, further comprising at least one venturi nozzle positioned adjacent to the multi-vein cyclonic separator.

8. The air filtration device of claim 1, wherein at least one of the at least two veins comprises a decreasing pitch along the entire axial length of the multi-vein cyclonic separator.

9. An air filtration device disposed proximate a rotary mining bit in a drillstring to separate liquid from a drilling fluid, the air filtration device comprising:

a cyclonic separator disposed within a housing configured to rotate with the drillstring, the cyclonic separator comprising a first vein having a tapered diameter along an axial length thereof and extending in a spiral along the length of the cyclonic separator, wherein the tapered diameter is measured traverse to the axial length and across the width of the spiral;

wherein the tapered first vein comprises a variable pitch along the length of the cyclonic separator;

holes in the housing positioned adjacent to edges of the first vein to allow liquid accelerated from the drilling fluid to exit the housing;

wherein the cyclonic separator is configured to provide high centrifugal forces downhole to the drilling fluid.

10. The air filtration device of claim 9, further comprising a second spiral vein, wherein the second spiral vein is co-axial with the first vein.

11. The air filtration device of claim 9, wherein the cyclonic separator is disposed in a rotary tool.

12. The air filtration device of claim 9, wherein the cyclonic separator is disposed in a drillstring immediately adjacent to the rotary tool.

13. The air filtration device of claim 9, wherein the cyclonic separator comprises a tapered core.

14. The air filtration device of claim 9, wherein the cyclonic separator is configured to produce increased vorticity values in the drilling fluid.

15. The air filtration device of claim 9, further comprising at least one venturi nozzle positioned adjacent to the cyclonic separator.

* * * * *

UNITED STATES PATENT AND TRADEMARK OFFICE

CERTIFICATE OF CORRECTION

PATENT NO. : 8,978,785 B2
APPLICATION NO. : 12/351163
DATED : March 17, 2015
INVENTOR(S) : Vincent Wayne Shotton It is certified that error appears in the above-identified patent and that said Letters Patent is hereby corrected as shown below:

In the Claims:

In column 8, line 38, in Claim 12, delete “the rotary tool” and insert --a rotary tool--, therefor.

Signed and Sealed this
Sixteenth Day of June, 2015

Michelle K. Lee

Michelle K. Lee
*Director of the United States Patent and Trademark Office*

UNITED STATES PATENT AND TRADEMARK OFFICE

CERTIFICATE OF CORRECTION

PATENT NO. : 8,978,785 B2
APPLICATION NO. : 12/351163
DATED : March 17, 2015
INVENTOR(S) : Vincent Wayne Shotton It is certified that error appears in the above-identified patent and that said Letters Patent is hereby corrected as shown below:

On the title page, item (73) Assignee, "Sandvik Mining and Construction (Shenandoah, TX)" should be --Sandvik Intellectual Property AB (Sandviken, Sweden)--.

Signed and Sealed this
Tenth Day of November, 2015

Michelle K. Lee

Michelle K. Lee
*Director of the United States Patent and Trademark Office*